US005529430A

United States Patent [19]

Jenkins

[11] Patent Number: 5,529,430

[45] Date of Patent: Jun. 25, 1996

[54] REFLECTIVE ROAD STUD

[76] Inventor: David H. Jenkins, 1 Langton Place, Charlton Kings, Cheltenham, GL51 8 HW, England

[21] Appl. No.: 410,305

[22] Filed: Mar. 24, 1995

Related U.S. Application Data

[63] Continuation-in-part of Ser. No. 307,002, Sep. 16, 1994, abandoned.

[30] Foreign Application Priority Data

Sep. 21, 1993 [GB] United Kingdom ..... 9319503

[51] Int. Cl.[6] ..... E01F 9/07; E01F 9/015

[52] U.S. Cl. ..... 404/11; 404/16

[58] Field of Search ..... 404/6, 9, 10, 11, 404/12, 13, 14, 15, 16; D10/113

[56] References Cited

U.S. PATENT DOCUMENTS

| | | | |
|---|---|---|---|
| D. 322,414 | 12/1991 | Scratcher | D10/113 |
| 2,146,359 | 2/1939 | Shaw . | |
| 4,130,370 | 12/1978 | Kone . | |
| 4,504,169 | 3/1985 | Jones | 404/11 |
| 4,854,768 | 8/1989 | Flanagan et al. | 404/11 |
| 5,257,875 | 11/1993 | Flanagan | 404/14 |

FOREIGN PATENT DOCUMENTS

| | | |
|---|---|---|
| 2323819 | 4/1977 | France . |
| 2609726 | 3/1977 | Germany . |
| 903938 | 8/1962 | United Kingdom . |
| 903939 | 8/1962 | United Kingdom . |
| 2229470 | 9/1990 | United Kingdom . |

*Primary Examiner*—William P. Neuder
*Assistant Examiner*—James A. Lisehora
*Attorney, Agent, or Firm*—Young & Thompson

[57] ABSTRACT

A reflective road stud comprises a hollow plastics body, a reflector support integral with the body and extending above the body, and a reflector supported by the reflector support. The support is movable into or towards the body upon receiving an impact from at least one of two opposite sides of the road stud. The reflector support includes two ramp surfaces on said at least one side of the road stud, the ramp surfaces extending in a direction substantially parallel to the in use direction of traffic flow. Wiper means may be provided for cleaning the reflector when the reflector is moved into or towards the body. The hollow body contains compressible, non-water absorbent means to prevent ice build up which may otherwise resist or prevent movement of the reflector support into or towards the body.

9 Claims, 5 Drawing Sheets

REFLECTIVE ROAD STUD

RELATED APPLICATION

This is a continuation-in-part application of Ser. No. 08/307,002 filed 16th Sep. 1994 now abandoned.

INTRODUCTION

This invention relates to a reflective road stud and more particularly to a reflective road stud which is resistant to impact by a snow plough.

Snow ploughs in some countries are set to traverse a path slightly above the road surface so as to prevent damage to the road surface and to reflective road studs set in the road surface. In other countries, the plough is set to make contact with the road surface with the result that reflective road studs set in the road surface are damaged or destroyed.

The present invention seeks to provide a reflective road stud which is resistant to impact by a snow plough.

SUMMARY OF THE INVENTION

According to the present invention there is provided a reflective road stud comprising a hollow plastics body, a reflector support integral with the body and extending above the body, and a reflector supported by the reflector support, the support being movable into or towards the body upon receiving an impact from at least one of two opposite sides of the road stud, wherein the reflector support includes two ramp surfaces on said at least one side of the road stud, the ramp surfaces extending in a direction substantially parallel to the in use direction of traffic flow so that, when impacted, the reflector support is moved into or towards the body and wherein the hollow body contains compressible, non-water absorbent means to prevent ice build up which may otherwise resist or prevent movement of the reflector support into or towards the body.

In one embodiment, the hollow body has two end walls extending parallel or substantially parallel to the in use direction of traffic flow and the reflector support has two ramp surfaces on each side of the road stud, two of the ramp surfaces, one on each side of the road stud, being connected to one end wall by two resilient arms and the other ramp surfaces, one on each side of the road stud, being connected to the other end wall by two further resilient arms.

In an alternative embodiment, the hollow body has two side walls extending transversely to the in use direction of traffic flow and the reflector support has two ramp surfaces on each of said two opposite sides of the road stud, the ramp surfaces on one side of the road stud being connected to one side wall and the ramp surfaces on the other side of the road stud being connected to the other side wall, the support being deformable into the body on receiving an impact from either of said two opposite sides of the road stud.

In another alternative embodiment, the hollow body has two side walls extending transversely to the in use direction of traffic flow and the ramp surfaces on said one side of the road stud are connected to one side wall and extend towards the other side, wall by more than half the distance between the two side walls.

In yet another embodiment, the hollow body has two side walls extending transversely to the in use direction of traffic flow and the reflector support has two ramp surfaces on each of said two opposite sides of the road stud, the ramp surfaces on one side of the road stud being connected to one side wall and being longer than the ramp surfaces on the other side of the road stud. In this case, preferably, the ramp surfaces on the other side of the road stud are free at their ends remote from said one side wall.

Preferably, the compressible, non-water absorbent means is a closed cell foam material, a blow moulding or solid elastomeric material.

Preferably, the road stud also comprises wiper means for cleaning the reflector when the reflector support is moved into or towards the body.

Preferably, the reflector support comprises a bar extending between the two ramp surfaces on said at least one side of the road stud and a reflector on at least one side of the bar. In this case, the wiper means, when provided, may be in the form of at least one blade integral with the body and extending inwards from said at least one side of the body towards the bar.

Preferably, the body and support are formed of flexible, impact and abrasion resistant, plastics material.

Preferably, the road stud also comprises a housing for receiving and locating the hollow plastics body.

The invention will now be more particularly described by way of example with reference to the accompanying drawings.

DESCRIPTION OF THE PREFERRED EMBODIMENTS

Figure 1:
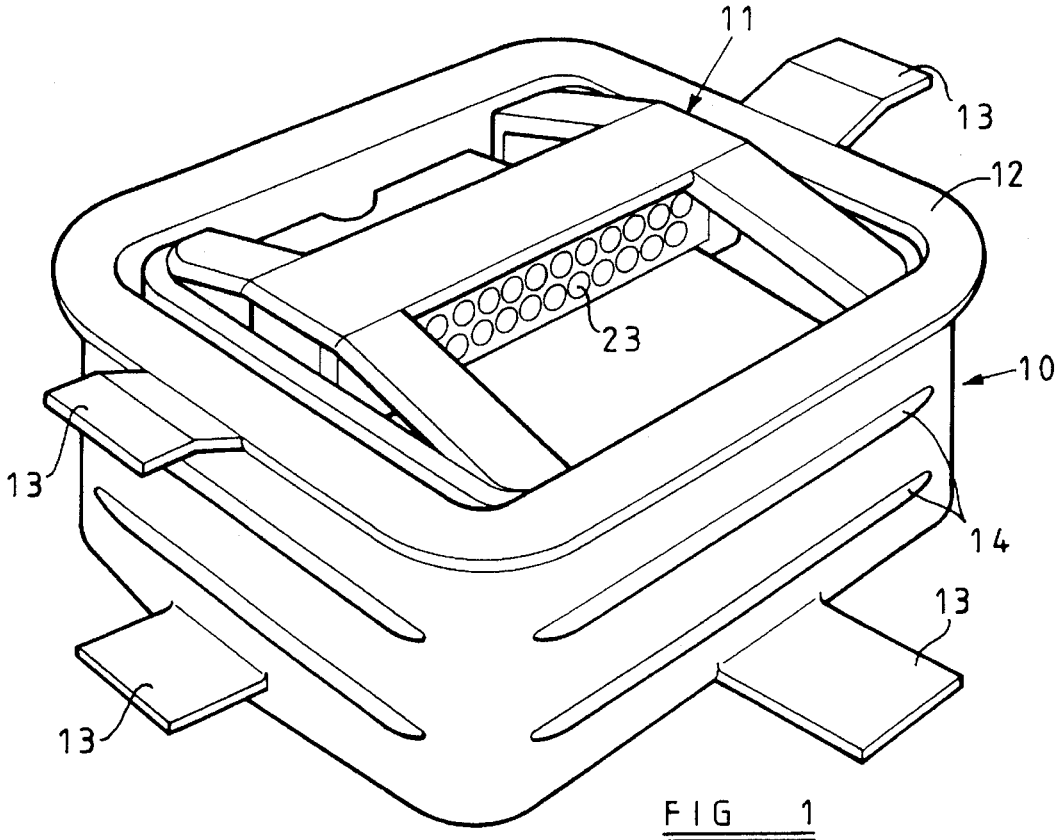
FIG. 1 is a perspective view of one embodiment of a road stud according to the invention.
Figure 2:
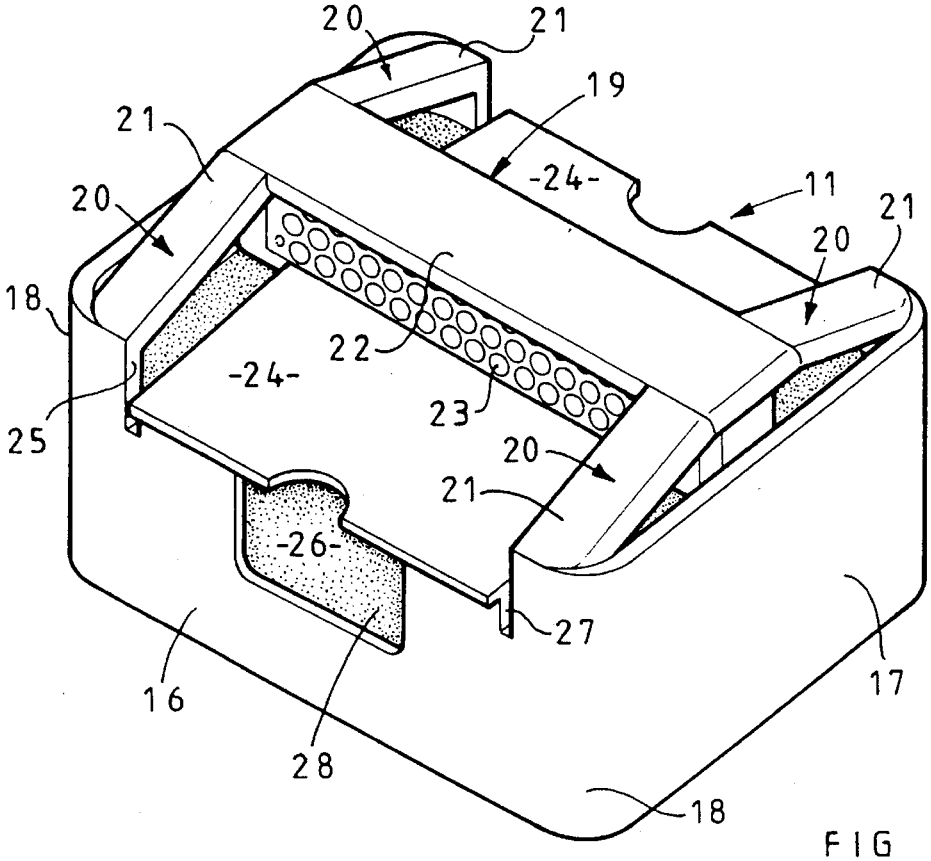
FIG. 2 is a perspective view of the road stud shown in FIG. 1 with the outer housing omitted.
Figure 3:
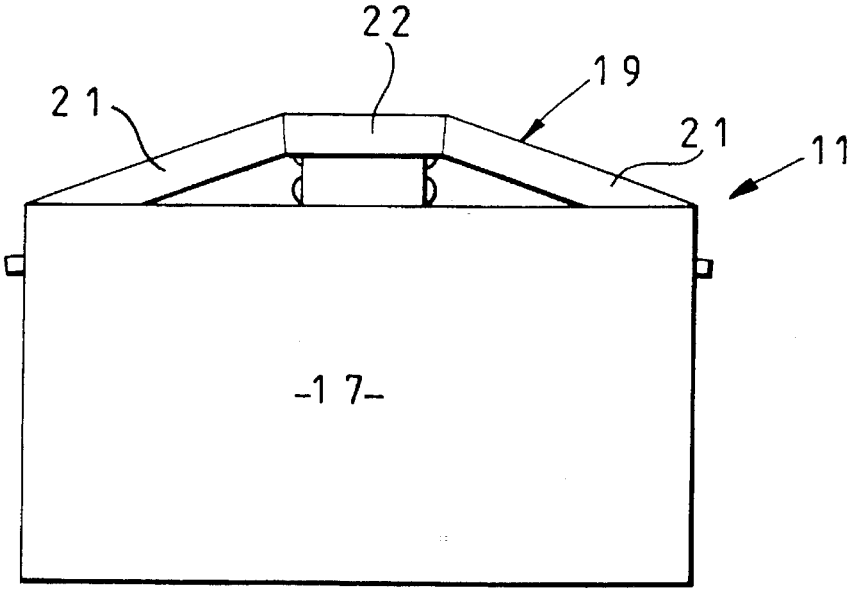
FIG. 3 is an end view of the road stud shown in FIG. 1 with the outer house omitted.
Figure 4:
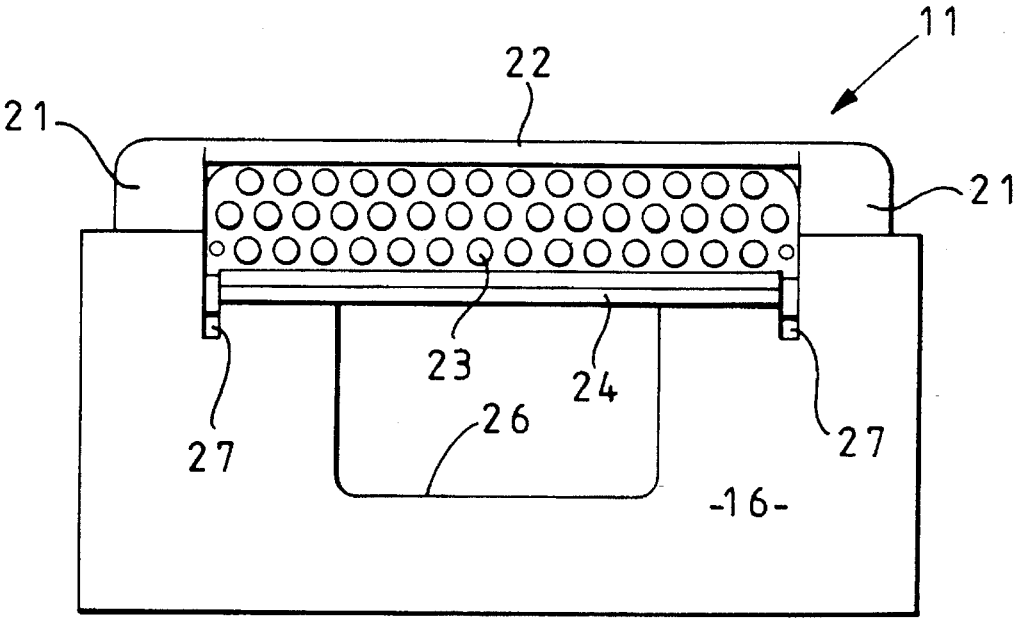
FIG. 4 is a front side view of the road stud shown in FIG. 1 with the outer housing omitted.
Figure 5:
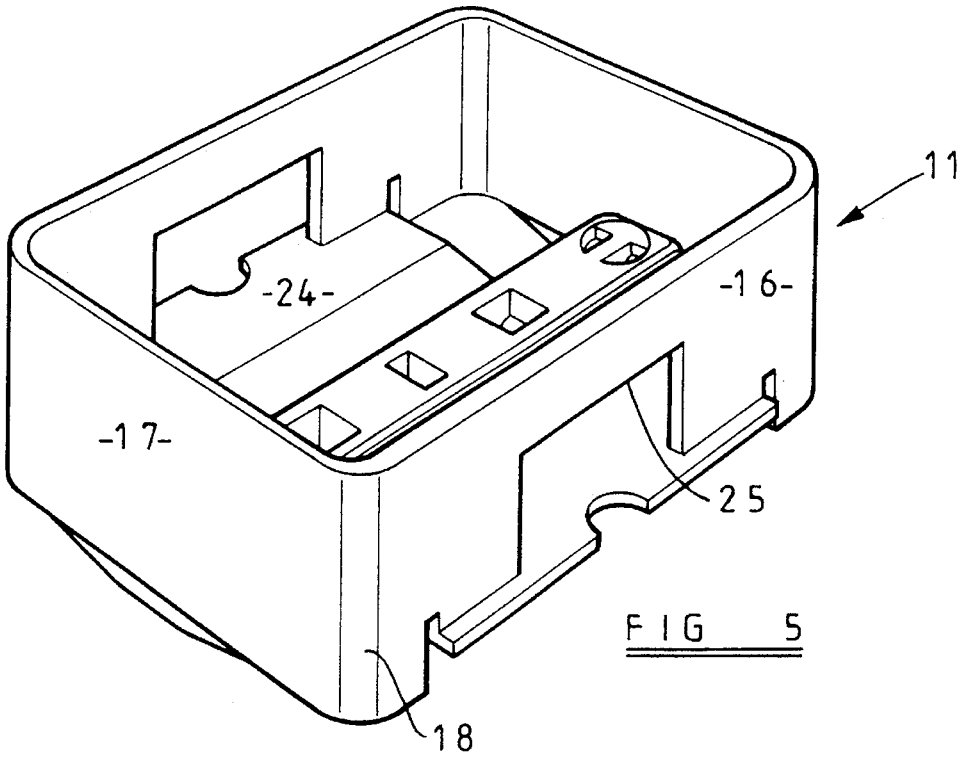
FIG. 5 is an underneath perspective view of the road stud shown in FIG. 1 with the outer housing omitted.
Figure 6:
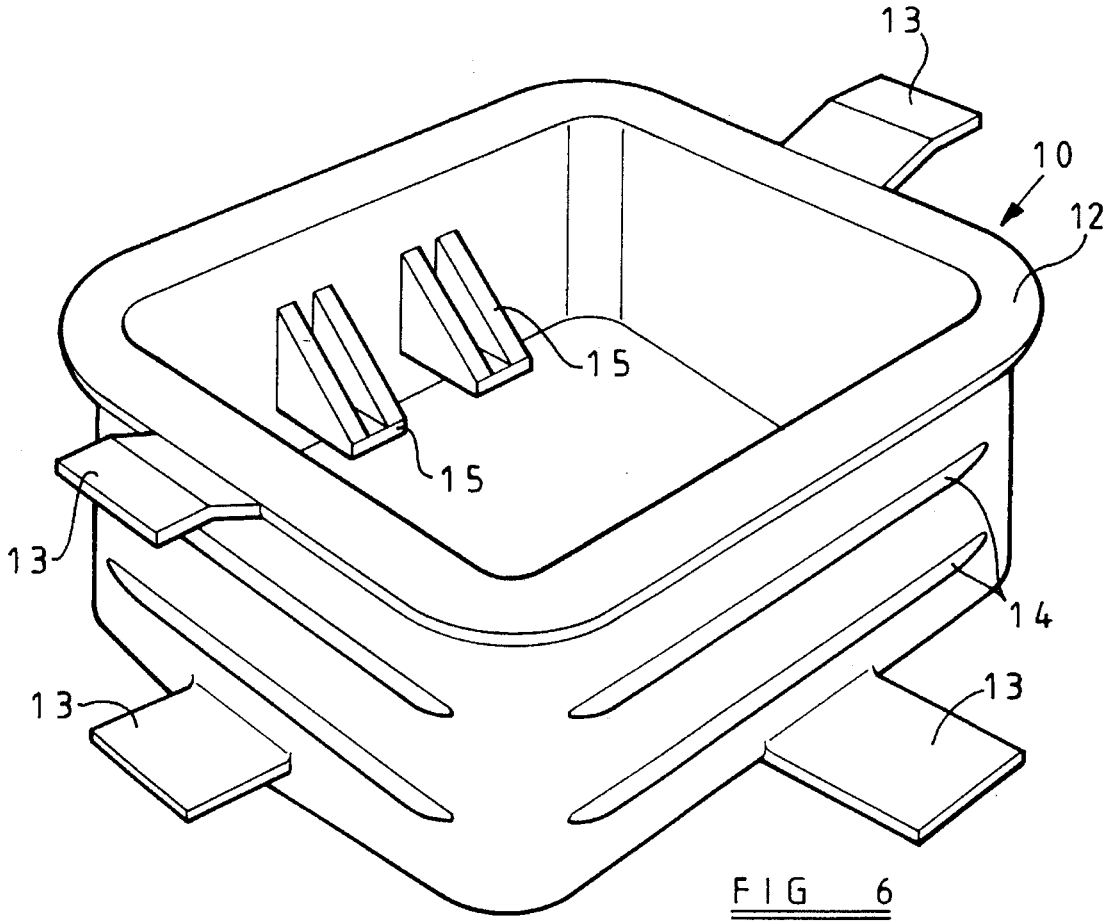
FIG. 6 is a perspective view of the outer housing.

Referring now to FIGS. 1 to 6 of the drawings, the reflective road stud shown therein comprises an outer plastics housing 10 and a hollow plastics body 11 located in the housing 10.

The housing 10 has a base and a generally rectangular wall with curved corner sections defining a cavity for receiving the body 11. The housing has a flange 12 at is upper end, six outwardly extending projections 13, external ribs 14 and four internal lugs 15. The housing 10 is located in a hole in the road surface and grouted in place. The dimensions of the hole are selected such that the lower projections 13 are deformed upwardly by engagement with the walls of the hole as the housing is placed in the hole to prevent the housing from floating when a grouting mixture is poured into the hole. The upper projections 13 contact the road surface to support the housing at the correct level while the housing is grouted in place. The ribs 14 help to key the housing to the grouting mixture and the internal lugs 15 co-operate with the body 11 in a manner to be described hereinafter.

The plastics body 11 has two side walls 16 and two end walls 17 joined by curved corner sections 18 and is open at the bottom. A reflector support 19 is provided at the top of the body 11 and is integral therewith.

The reflector support 19 comprises two ramp surfaces 20 on each side of the body 11 and at opposite ends, respectively, of the body 11. The ramp surfaces 20 are defined by arms 21 which are inclined upwards from respective side walls 16 and which are joined in the centre by a bar 22 extending between the ends of the body 11.

A reflector 23, which may be formed of biconvex lenses or which may be a cube-corner-type retrodirective reflector or prismatic, is secured to each of the two longitudinally extending sides of the bar 22.

The angle the arms 21 make with the horizontal should be as small as possible to keep the height of the reflector 23 above the road surface to a minimum whilst still maintaining the required optical performance.

The body 11 and reflector support 19 are formed of flexible, abrasion and impact resistant, plastics material such as that made and sold by Hoechst Polymers under the name Riteflex (TM) and the reflector support 19 is such that it will deform into the body 11 upon receiving an impact from either of two opposite sides of the road stud or from above. The housing 10 may be formed of the same plastics material.

The road stud also comprises two wiper blades 24 which are integral with the body 11 and which extend inwards from respective side walls 16 at positions immediately below elongate recesses 25 formed in the upper edges of the two side walls 16 respectively. The blades 24 extend as far as the bar 22 and wipe the surfaces of the reflectors 23 each time the reflector support 19 is deformed into the body 11 to clean the reflectors 23. A recess 26 is formed in each side wall 16 immediately below the wiper blades 24 for snap fittably receiving the internal lugs 15 of the housing 10. The blades overhang the outer surface of the side walls 16 by a short distance and co-operate with the wall of the housing 10 to keep the wiper blades 24 in contact with the reflectors 23 when the reflector support 19 is deformed into the body 11. Slits 27 are provided in the side walls 16 at opposite ends of the wiper blades 24 to allow the reflector support 19 to be deformed into the body 11 without deforming the wiper blades 24.

The body 11 is located as a snap fit in the housing 10 with the upper edge of the body 10 flush with or slightly below the upper surface of the housing 10 and with the reflector support 19 lying proud of the upper surface of the housing 10.

The body 11 is substantially filled with closed cell foam material 28 which has a trough or recess in its upper surface to receive the bar 22 and reflectors 23 when the reflector support 19 is deformed into the body 11. This foam material is impervious to water and therefore prevents ice build up which could otherwise resist or prevent deformation of the reflector support 19 into the body 11.

The trough or recess is dimensioned such that in normal usage the bottom of the bar 22 does not come into contact with the foam material. The trough or recess can, however, fill with ice. The thickness of the foam material must be sufficient to accommodate full depression of the reflector by a snow plough. For example, if the foam material can only compress to half its expanded thickness, the thickness of the foam material at the base of the trough must be at least twice the combined height of the bar 22 and any ice in the trough or recess.

A blow moulding, solid elastomeric material or other compressible, non-water absorbent means could be used instead of the foam material.

In use, the reflector support 19 will deform into the body 11 when impacted by a snow plough to prevent damage to the road stud. The reflector support 19 will also be deformed into the body 11 when a vehicle wheel passes over the road stud and contact between the wiper blades 24 and the reflectors 23 when this happens will ensure that the reflectors 23 are kept reasonably clean. The foam material may also assist in cleaning the reflectors 23 when the reflector support 19 is deformed into the body 11.

Figure 7:
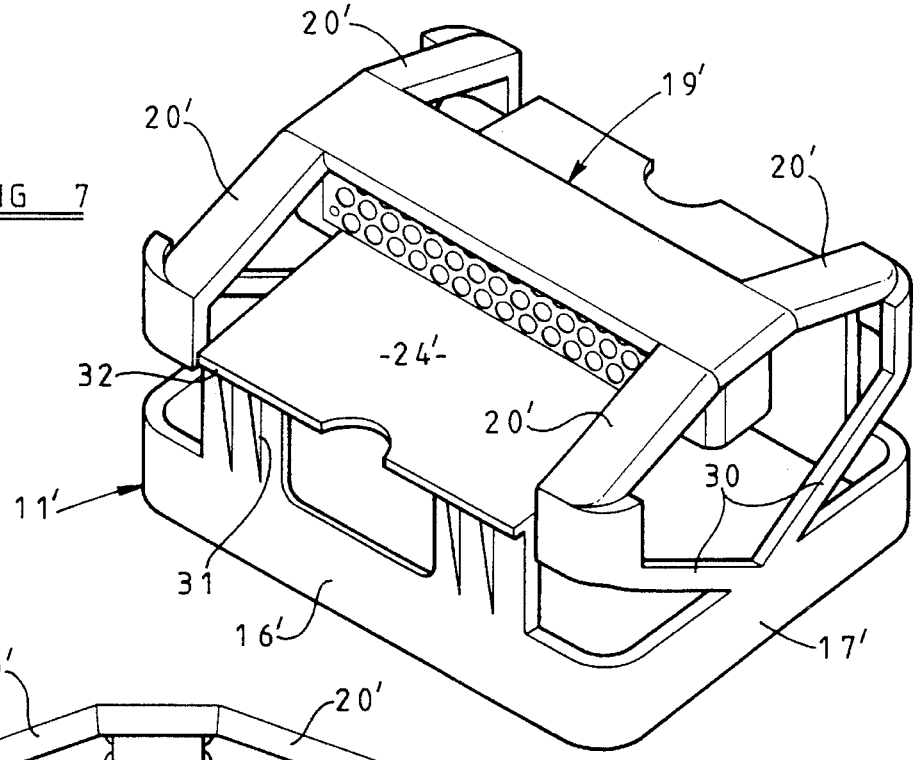
FIG. 7 is a view similar to FIG. 2 of another embodiment of a road stud according to the invention.
Figure 8:
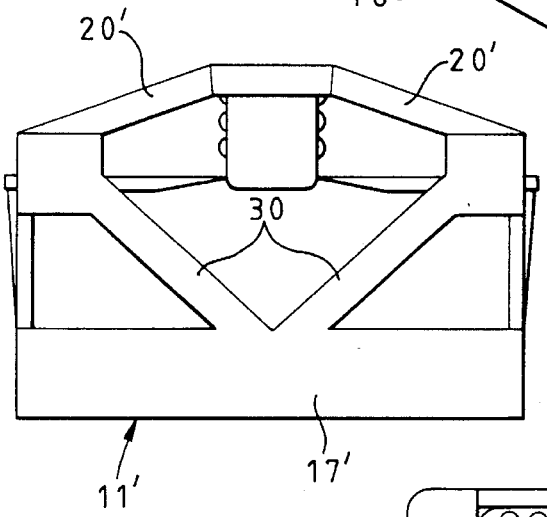
FIG. 8 is an end view of the road stud shown in FIG. 7.
Figure 9:
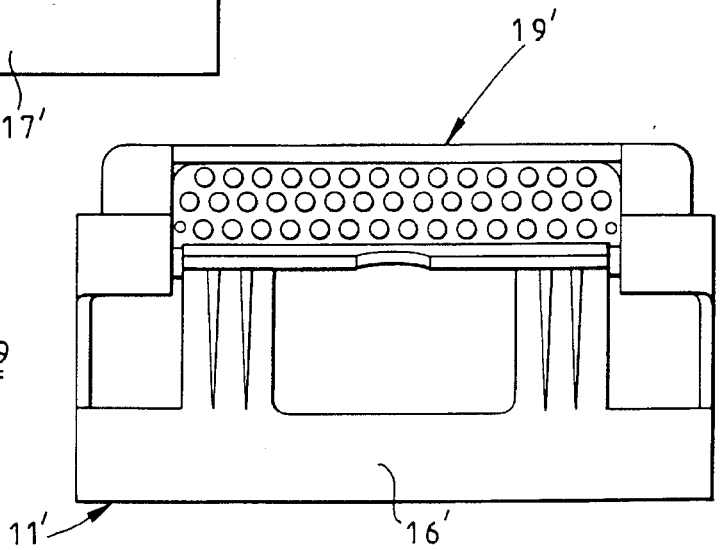
FIG. 9 is a front side view of the road stud shown in FIG. 7.

The reflective road stud shown in FIGS. 7 to 9 differs from the above road stud in that the body $\mathbf{11}^1$ is shorter except where it supports the wiper blades $\mathbf{24}^1$ and the ramp arms $\mathbf{21}^1$ defining the surfaces $\mathbf{20}^1$ are connected to the two end walls $\mathbf{17}^1$ of the body by resilient arms 30 instead of being connected directly to side walls of the body. The resilient arms 30 converge towards the body $\mathbf{11}^1$ and are integral with the body $\mathbf{11}^1$ at positions substantially midway between the ends of the end walls $\mathbf{17}^1$ of the body. The resilient arms 30 are of smaller cross-sectional area than the arms $\mathbf{21}^1$ and move down to allow the reflector support $\mathbf{19}^1$ to move towards the body $\mathbf{11}^1$ when the ramp surfaces receive an impact from either of the two opposite sides of the road stud. This should enable the road stud to respond more quickly to an impact and this may be necessary or desirable if the road stud is to resist impact from fast moving snow ploughs.

Also, buttresses 31 are provided on the side walls $\mathbf{16}^1$ and are integral at their upper ends with the overhanging portions 32 of the wiper blades $\mathbf{24}^1$. These buttresses 31 help maintain contact between the blades $\mathbf{24}^1$ and the reflectors $\mathbf{23}^1$ when the reflector support $\mathbf{19}^1$ is moved downwards towards the body $\mathbf{11}^1$ and also facilitate insertion of the body $\mathbf{11}^1$ into its outer plastics housing 10.

Figure 10:
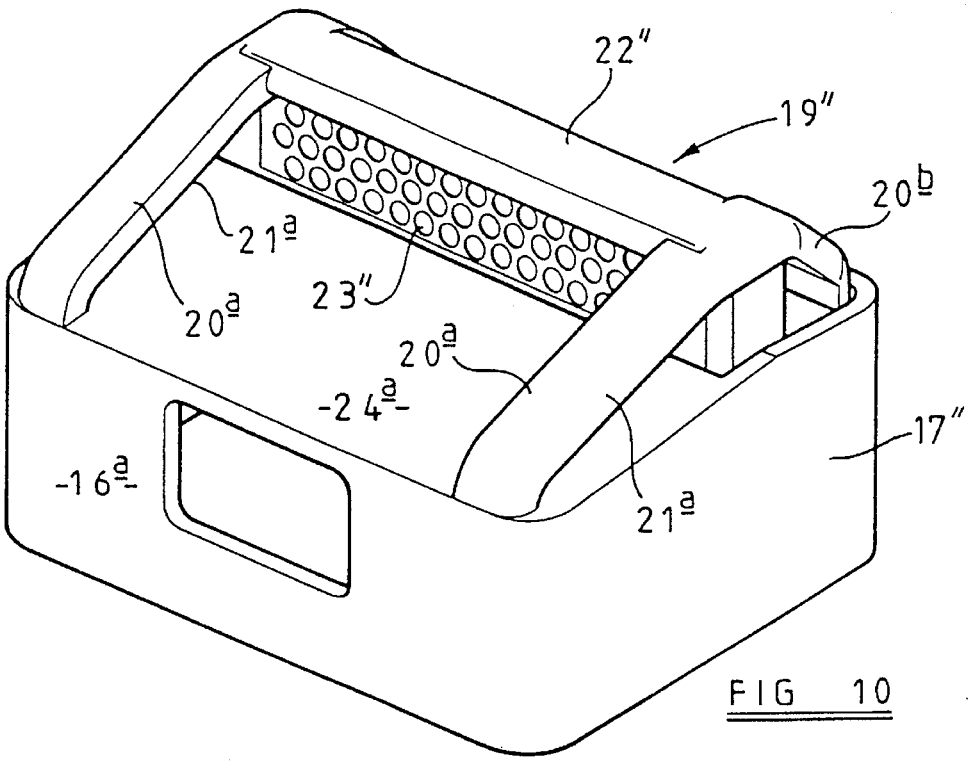
FIG. 10 is a perspective view from one side and one end of yet another embodiment of a road stud according to the invention.
Figure 11:
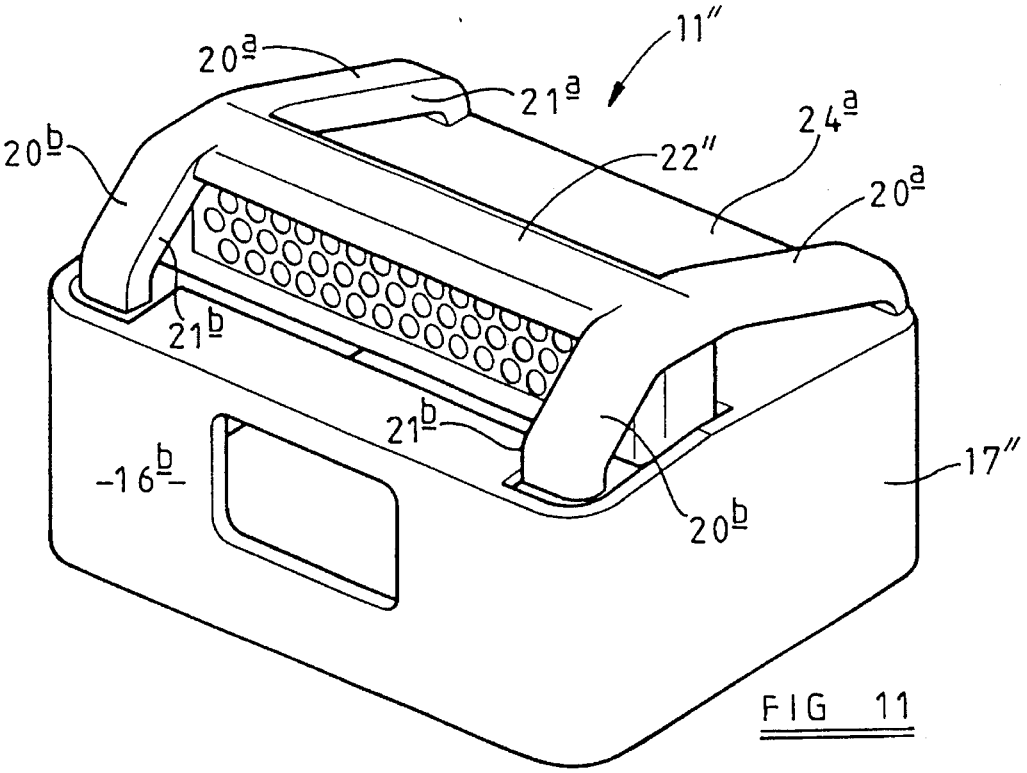
FIG. 11 is a perspective view from the other side and the other end of the road stud shown in FIG. 10.

The reflective road stud shown in FIGS. 10 and 11 differs from the road stud shown in FIGS. 1 to 6 in that the ramp surfaces **20*a* on one side of the road stud are longer than the ramp surfaces 20*b* on the other side of the road stud. The arms 21*a* defining the ramp surfaces 20*a* are connected to the side wall 16*a* and, preferably, extend towards the side wall 16*b* by more than half the distance between the two side walls. The arms 2l*b* defining the ramp surfaces 20*b* are free at their ends remote from the bar $\mathbf{22}^{11}$ and are offset inwardly from the side wall 16*b*** of the body $\mathbf{11}^{11}$ to allow the reflector support $\mathbf{19}^{11}$ to deform more easily into the body$^{11}$ on impact.

This road stud is for use on dual carriageway roads, such as motorways and expressways, in which traffic flow is generally in one direction only. The ramp surfaces **20*a* are designed to receive an impact from traffic and, due to their relatively longer length, can be inclined at a smaller angle than the ramp surfaces of the road stud shown in FIGS. 1 to 6** to reduce the angle of attack from a snow plough. This should enable the road stud to respond more quickly to an impact.

The arms **21*b* and hence the ramp surfaces 20*b*** could be omitted altogether. However, their presence is desirable in order to receive the impact of a vehicle reversing along the carriageway.

In order to ensure that the reflector(s) $23^{11}$ remain vertical or substantially vertical when the reflector support $19^{11}$ is deformed into the body $11^{11}$ the arms 21*a* have convexly curved portions at their ends adjacent to the side wall 16*a*.

The wiper blade 24*a* is integral with the side wall 16*a* and also with both end walls $17^{11}$.

The body $11^{11}$ will contain closed cell foam material or other compressible, non-water absorbent means and may have buttresses similar to the buttresses 31 shown in FIG. 7.

The embodiments described above are given by way of example only and various modifications will be apparent to persons skilled in the art without departing from the scope of the invention. For example, the ramp surfaces 20 could be arcuate rather than flat. Each reflector 23 could be supported from below so as to lie in a plane parallel to and slightly below the upper surfaces of the two ramp surfaces on a respective side of the road stud. In this case, the reflector would, at least to some extent, be self cleaning as vehicles pass over the reflector and no wiper blades would be provided. This arrangement may be beneficial if it is found that the road studs described above suffer from damage caused by the edge of a snow plough making contact with the bar of the reflector support. Also, the housing 10 could be omitted and the body 11 could be set in a hole in the road by adhesive.

What is claimed is:

1. A reflective road stud comprising:

a hollow plastics body, a reflector support integrally formed with the body from a flexible, abrasion and impact resistant plastics material, said reflector support extending above the body, a reflector supported by the reflector support, the support being movable into or towards the body upon receiving an impact from at least one of two opposite sides of the road stud, wherein the reflector support includes two arms each defining a ramp surface on said at least one side of the road stud, the ramp surfaces extending in a direction substantially parallel to the in-use direction of traffic flow so that, when impacted, the arms flex and deflect and the reflector support is moved into or towards the body and wherein the hollow body contains compressible, non-water absorbent means separated from the reflector support to prevent compression of said non-absorbent means during normal usage, said non-water absorbent means preventing ice build up which may otherwise resist or prevent movement of the reflector support into or towards the body.

2. A reflective road stud as claimed in claim 1, wherein the hollow body has two side walls extending transversely to the in use direction of traffic flow and wherein the reflector support has two ramp surface defining arms on each of said two opposite sides of the road stud, the arms on one side of the road stud being connected to one side wall and the arms on the other side of the road stud being connected to the other side wall, the support being deformable into the body on receiving an impact from either of said two opposite sides of the road stud.

3. A reflective road stud as claimed in claim 1, wherein the hollow body has two end walls extending parallel or substantially parallel to the in use direction of traffic flow and wherein the reflector support has two ramp surface defining arms on each side of the road stud, two of the ramp surface defining arms; one on each side of the road stud, being connected to one end wall by two resilient further arms and the other ramp surface defining arms, one on each side of the road stud, being connected to the other end wall by another two resilient further arms.

4. A reflective road stud as claimed in claim 1, wherein the hollow body has two side walls extending transversely to the in use direction of traffic flow and wherein the ramp surface defining arms on said one side of the road stud are connected to one side wall and extend towards the other side wall by more than half the distance between the two side walls.

5. A reflective road stud as claimed in claim 1, wherein the compressible non-water absorbent means is a closed cell foam material, a blow moulding or solid elastomeric material.

6. A reflective road stud as claimed in claim 1, further comprising wiper means for cleaning the reflector when the reflector support is moved into or towards the body.

7. A reflective road stud as claimed in claim 1, wherein the reflector support comprises a bar extending between the two ramp surface defining arms on said at least one side of the road stud and a reflector on at least one side of the bar.

8. A reflective road stud as claimed in claim 7, further comprising wiper means for cleaning the reflector when the reflector support is moved into or towards the body, the wiper means being in the form of at least one blade integral with the body and extending inwards from said at least one side of the body towards the bar.

9. A reflective road stud comprising a hollow plastics body, a reflector support integral with the body and extending above the body, and a reflector supported by the reflector support, the support being movable into or towards the body upon receiving an impact from at least one of two opposite sides of the road stud, wherein the reflector support includes two ramp surfaces on said at least one side of the road stud, the ramp surfaces extending in a direction substantially parallel to the in-use direction of traffic flow so that, when impacted, the reflector support is moved into or towards the body and wherein the hollow body contains compressible, non-water absorbent means to prevent ice build up which may otherwise resist or prevent movement of the reflector support into or towards the body, wherein the hollow body has two side walls extending transversely to the in-use direction of traffic flow and wherein the reflector support has two ramp surfaces on each of said two opposite sides of the road stud, the ramp surfaces on one side of the road stud being connected to one side wall and being longer than the ramp surfaces on the other side of the road stud, and wherein the ramp surfaces on the other side of the rod stud are free at their ends remote from said one side wall.

* * * * *